US008287250B2

(12) United States Patent
Tanigawa

(10) Patent No.: US 8,287,250 B2
(45) Date of Patent: Oct. 16, 2012

(54) MULTISTAGE VACUUM PUMP UNIT AND AN OPERATION METHOD THEREOF

(75) Inventor: Shiro Tanigawa, Yokohama (JP)

(73) Assignee: Anest Iwata Corporation (JP)

( * ) Notice: Subject to any disclaimer, the term of this patent is extended or adjusted under 35 U.S.C. 154(b) by 322 days.

(21) Appl. No.: 12/410,116

(22) Filed: Mar. 24, 2009

(65) Prior Publication Data

US 2009/0246040 A1 Oct. 1, 2009

(30) Foreign Application Priority Data

Mar. 24, 2008 (JP) ..... 2008-76234

(51) Int. Cl.
*F04B 23/04* (2006.01)
*F04B 23/00* (2006.01)

(52) U.S. Cl. ..... 417/252; 417/205; 417/206

(58) Field of Classification Search ..... 417/1–2, 417/26, 142, 205–206, 246–247, 251–252
See application file for complete search history.

(56) References Cited

U.S. PATENT DOCUMENTS 3,642,384 A * 2/1972 Huse ..... 417/205
4,138,862 A * 2/1979 Muller ..... 62/508
4,714,415 A 12/1987 Mizuno et al.
5,961,297 A 10/1999 Haga et al.

FOREIGN PATENT DOCUMENTS

JP 62-48979 A 3/1987
JP 8-270582 A 10/1996
JP 8270582 A 10/1996

OTHER PUBLICATIONS

Chinese Office Action issued in corresponding application No. CN200910128249.X, dated Apr. 18, 2012. English translation provided.
Japanese Office Action issued in corresponding Japanese application No. JP 2008-076234, dated Jun. 29, 2012. English translation provided.

* cited by examiner

*Primary Examiner* — Anh Mai
*Assistant Examiner* — Nathaniel Lee
(74) *Attorney, Agent, or Firm* — Rossi, Kimms & McDowell LLP

(57) ABSTRACT

A multistage vacuum pump unit can save a power requirement and prevent the gas discharged outside of the unit from flowing-back inside the pump unit. A plurality of vacuum pumps are connected in series to form the multistage vacuum pump unit. A suction inlet of a first stage vacuum pump thereof is connected to a to-be-vacuumized container so that the space inside of the container becomes under a high vacuum condition. In an operating method, part of the gas discharged into a first intermediate passage from the first stage vacuum pump is branched during a low vacuum operation, and discharged toward an air atmosphere through a low conductance line provided with check valves that prevent the branched gas from flowing back.

10 Claims, 2 Drawing Sheets

MULTISTAGE VACUUM PUMP UNIT AND AN OPERATION METHOD THEREOF

BACKGROUND OF THE INVENTION

1. Field of the Invention

This application relates to a multistage vacuum pump unit and an operation method thereof, whereby energy-consumption-saving (a power requirement reduction) is achieved while the unit is started and an obtained vacuum state is under a low vacuum condition.

2. Description of the Related Arts

In conventional vacuum pumps, each pump requires maximum power of its own while the pump is started and an obtained vacuum state is under a low vacuum condition. As the gas pressure in a to-be-vacuumized container is lowered, power demand is gradually reduced. Thus, the power demand becomes minimal when an obtained vacuum pressure reaches a reference vacuum pressure, or an expected vacuum pressure.

Some of the conventional vacuum pumps adopt a speed control for themselves when the obtained pressures become closer to ultimate (goal) pressures (high vacuum pressures), so that the above-described energy-consumption-saving (a power requirement reduction) is achieved; however, according to this manner, a little can be expected as to the power reduction during the low vacuum operation.

In other words, according to the above manner, not only the above-described maximum power but also a starting power (such as an overshooting of a power requirement) are required when the vacuum pumps are started, for instance, in the case where the gas pressure in a to-be-vacuumized container is equal to a level of an atmospheric pressure; thus, a driving motor of a large power rating becomes necessary, and the cost of facilities is increased. Accordingly, when the energy-consumption-saving (a power requirement reduction) during the low vacuum operation after starting a vacuum pump is achieved, the cost of facilities can be reduced thanks to the power reduction effect as to the vacuum pump.

Japanese Laid-open patent application No. S62-48979 discloses a scroll compressor provided with a structure so as to reduce a power requirement reduction in starting the compressor. The compressor comprises a stationary scroll and an orbiting scroll that form a first compression space and a second compression space. When the compressed gas pressure in the first space exceeds that in the second space, the compressed gas in the first space is discharged into the second space by means of at least one open-and-close valve. Further, the gas discharged into the second space is discharged outside when the second space is in communication with a discharging port that connects the second space toward outside of the scroll compressor.

If the structure disclosed in Japanese Laid-open patent application No. S62-48979 is straightly applied to the multistage vacuum pump as a structure thereof, and a highly compressed gas generated in a preceding stage vacuum pump is discharged into a subsequent stage vacuum pump, then the gas pressure in a gas flow passage of the succeeding stage vacuum pump becomes excessively high and a power requirement reduction can not be achieved. On the contrary, high heat may be emitted in the subsequent stage vacuum pump.

Japanese Laid-open patent application No. H8-270582 discloses a scroll type two-stage vacuum pump that overcomes the difficulties in implementing the improvements of the patent reference 1 as well as in reducing the emitted heat in a viscous gas flow region of a low vacuum; the structure of the reference 2 is provided with a by-pass passage that connects a discharge outlet of a preceding stage scroll pump, to an intermediate passage between a discharge outlet of the preceding stage scroll pump and a suction inlet of a succeeding stage scroll pump, while the intermediate passage is provided with a pressure control valve that closes the passage when the pressure in the intermediate passage becomes lower than a predetermined pressure.

In the above-described structure, when the pressure in a to-be-vacuumized container is closer to an atmospheric pressure at an early stage in starting the vacuum pump, and the discharge pressure of the preceding stage scroll pump is higher than a predetermined pressure, for instance, an ambient pressure, then the above described pressure control valve is opened, and the high pressure gas at the preceding stage scroll pump outlet is discharged outside through the by-pass passage without being delivered to the succeeding stage scroll pump. In this manner, an excessive pressure accompanied by high-heat in the succeeding stage scroll pump can be prevented; in addition, a durability-deterioration as well as a seizure-problem due to the high heat in the vacuum pump can be prevented.

According to Japanese Laid-open patent application No. H8-270582, the disclosed structure comprises:

an intermediate passage between a discharge outlet of a preceding stage scroll pump and a suction inlet of the succeeding stage scroll pump;

a by-pass passage that connects a discharge outlet of a succeeding stage scroll pump, to an intermediate passage. Hereby, it is noted that an outlet pressure of the succeeding stage scroll pump is closer to an atmospheric pressure, since the compressed gas is released toward outside at the outlet.

Therefore, a pressure difference is developed between the outlet of the succeeding stage scroll pump and a place along the gas passage inside the vacuum pump in response to a produced high vacuum in a to-be-vacuumized container (a closed container as a load absorbing element); thus, there arises a risk that outside gas or air flows back inside of the vacuum pump, through the by-pass passage and the pressure control valve. The potential back-flow causes a difficulty that an operational efficiency of the vacuum pump is lowered.

SUMMARY OF THE INVENTION

In view of the described subjects of the conventional technology, the present invention aims at a multistage vacuum pump unit that can save a power requirement at an early stage in starting as well as can prevent the gas discharged outside from flowing-back inside of the pump as is the problem in Japanese Laid-open patent application No. H8-270582 as described above.

In order to reach the above goals, the present invention discloses an operation method of a multistage vacuum pump unit wherein a plurality of vacuum pumps are connected in series so as to form the multistage vacuum pump unit; a suction inlet of a first stage vacuum pump is connected to a to-be-vacuumized container so that the space inside of the container becomes under a high vacuum condition; the method comprises the steps of branding a part of gas discharged from the first stage vacuum pump during a low vacuum operation after starting the vacuum pump unit; and discharging the branched gas toward an air atmosphere through a low conductance line (passage) provided with at least one check valve that prevents the branched gas from flowing back.

It is hereby noted that the conductance is defined as a ratio of a flow rate to a pressure difference. It is also noted that this application uses the terms of a low vacuum operation zone as well as a high vacuum operation zone. The former is defined as a zone in which operation-state parameters such as pressures, flow rates, pump speeds and so on are of a low vacuum state-operation after the vacuum pump unit is started, while the latter is defined as a zone in which the operation-state parameters are of a high vacuum state-operation. Further, this application allows such an expression that an element of the unit is in the low vacuum operation zone or in the high vacuum operation zone.

In the method of the present invention, while the multistage vacuum pump unit is under the low vacuum operation zone, a part of the gas is branched at a discharge side of a lower number stage vacuum-pump as well as on a upstream side of the next stage pump gas-inlet. Here, it is noted that the lower number stage vacuum-pump includes not only the first stage vacuum-pump but also other vacuum-pumps near to the gas-inlet side of the multistage vacuum pump unit; namely, the lower number stage vacuum-pump may be one of the second stage vacuum-pump, the third stage vacuum-pump and so on. The branched part of the discharged gas is led outside of a vacuum-pump unit casing of the multistage vacuum-pump unit, so that a power requirement for the vacuum-pump unit during the low vacuum operation can be reduced. So can be the vacuum-pump unit free from an excessive pressurizing of the next stage vacuum-pump on the gas flow passage after the part of the gas is branched; in addition, the necessary power to drive the vacuum-pumps can be reduced.

In the method of the present invention, a main gas flow that pass through the multistage vacuum pump unit is branched at an outlet side of at-least-one vacuum pump out of lower number stages near to the suction side of the pump unit, toward an air atmosphere, through a low conductance line (passage) that is provided with at least one check valve that prevents the branched gas from flowing back. In response to a transition from a low vacuum operation after starting the vacuum pump unit to a high vacuum operation, a gas pressure difference between an air atmosphere and the gas inside of the vacuum pump gradually becomes larger; yet, the branched gas is prevented from flowing back by means of a gas discharge through the low conductance line. Thus, the operational efficiency of the vacuum pump unit can not be worsened.

A viscous gas under a relatively high pressure can pass through a low conductance line, while it is difficult for a molecular gas flow of a low-pressure gas or a transition (an intermediate) gas flow of an intermediate-pressure gas to pass through the low conductance line.

Thus, the present invention enables a viscous gas flow that is branched from a vacuum pump of a lower number stage, in a low vacuum operation zone, to pass through the low conductance line. The present invention also enables a molecular gas flow or a transition (an intermediate) gas flow, in a high vacuum operation zone, to be prevented from flowing back (toward the branched passage or inside of the vacuum pump unit) from the outlet side of the low conductance line.

The low conductance line may be configured to form a long flow passage with a small inner diameter, for instance, so as to obtain a large pressure drop. For example, the inner diameter is to be less than 5 mm, or more particularly 4 to 5 mm. Even a trace quantity of gas flow-back can be prevented with a high degree of accuracy, thanks to a flow-back prevention effect due to the low conductance line and the check valve fitted on the conductance line.

Preferably in the present invention, the branched gas flows into a discharge passage of the final stage vacuum pump in the vacuum pump unit, after passing through the low conductance line; and, the branched gas is discharged toward an air atmosphere, together with the discharge gas from the final stage vacuum pump, through the discharge passage of the final stage vacuum pump in the vacuum pump unit. In a high vacuum operation zone, the pressure of the discharge gas at the downstream side of the low conductance line becomes closer to that of a molecular gas flow or a transition (an intermediate) gas flow; thus, the gas can be further effectively prevented from flowing-back.

Preferably, in the present invention, the check valve on the low conductance line is opened only when the pressure of the branched gas is higher than the pressure of an air atmosphere as well as lower than the pressure of the gas at the gas-outlet of the lower number stage vacuum-pump near to the gas-inlet side of the vacuum-pump unit in a low vacuum operation zone. Thus, in a case when the pressure of the gas discharged from the lower number stage vacuum pump exceeds an air atmosphere pressure in the low vacuum operation zone, a part of the branched gas can be emitted through the low conductance line toward an air atmosphere; thereby, the pressure of the emitted gas can be lower than the air atmosphere pressure. Thus, the gas pressure at the gas-inlet side of the next stage vacuum pump can be lowered so as to reduce a power requirement for the next pump.

This application discloses a multistage vacuum pump unit comprising a plurality of vacuum pumps that are connected in a series and in a multistage type, so that the space inside of a to-be-vacuumized container becomes under a high vacuum condition; a branch passage that is branched from an gas-outlet of a lower number stage vacuum pump near to a gas-inlet of the vacuum pump unit, toward an air atmosphere; a low conductance line as a part of the branch passage; at least one check valve provided on the low conductance line so as to secure the low conductance property of the line; whereby, a part of a gas discharged from the gas-outlet of the lower number stage vacuum pump is branched and emitted toward an air atmosphere through the low conductance line.

With the configuration as described above, by branching a part of a gas discharged from the gas-outlet of the lower number stage vacuum pump near to a gas-inlet of the vacuum pump unit to be emitted toward an air atmosphere through the low conductance line in a low vacuum operation zone, the gas pressure at the gas-inlet side of the next stage vacuum pump can be lowered and a power requirement for the next pump can be reduced. Moreover, since a part of the branch passage is configured to have the low conductance line therein which is provided with at least one check valve on the line, a back flow of the gas from an air atmosphere through the low conductance line can be prevented.

Preferably, in the multistage vacuum pump unit according to the present invention, the branch passage is led outside of the pump unit casing, and the branch passage or the low conductance line as a part of the branch passage is cooled by a cooling means outside the pump unit casing. Thus, a thermal load all over the multistage vacuum pump unit due to heat generation in response to gas pressurization can be lightened, and each pump in the vacuum pump unit can be free from a potential seizure risk. For instance, either of cooling devices, a water-cooling type or an air-cooling type, can be adopted as a cooling means.

For example, as a cooling device of an air cooling type, such a cooling device can be adopted that delivers a cooling air, by means of a fan, toward the branch passage or the low conductance line as a part of the branch passage, whereby a plurality of fins are implanted in the outer periphery of the branch passage. Instead of the cooling device of a forced cooling type just as described, an air-cooling device of a natural cooling type can be adopted also. In a case of a water-cooling type, the branch passage can be laid down in a water tank, or can be passed through a water jacket in which cooling circulation water is led.

Preferably, in the multistage vacuum pump unit according to the present invention, a first check valve and a second check valve are installed on a part way of the branch passage so that the low conductance line is placed between the two check valves, and the opening pressure of the second check valve is set with a pressure greater than that of the first check valve; and, the low conductance line forms a buffer-space that provisionally accumulates the gas branched into the low conductance line.

With the configuration as described above, the low conductance line can form a buffer-space that provisionally accumulates the gas inside the line; therefore, the buffer-space can prevent a flow-back of the branched gas with an enhanced efficiency, and can promote a cooling effect of the branched gas. Moreover, according to the configuration just described, there is an advantage in relieving a fluctuation in the load required for a drive gear of the multistage vacuum pump unit, thanks to the buffer-space.

According to the present invention, in the method to operate a multistage vacuum pump unit, comprising a plurality of vacuum pumps that are connected in a series and in a multistage type, so that the space inside of a to-be-vacuumized container becomes under a medium or high vacuum condition; the method comprises the steps of branching a part of a gas discharged from a gas-outlet of a lower number stage vacuum pump while the unit is operated under a low vacuum condition; and discharging the branched gas, toward an air atmosphere, through a branch passage including a low conductance line on which at least one check valve is provided for preventing the branched gas from flowing back. Therefore, the power requirement in driving the vacuum pumps after they are started or while they are in a low operation zone can be reduced; further, even infinitesimal flow-back of the branched gas can be prevented. As a result, the operational efficiency of the vacuum pump unit cannot be worsened.

According to the present invention, a multistage vacuum pump unit comprises a plurality of vacuum pumps that are connected in a series and in a multistage type, so that the space inside of a to-be-vacuumized container becomes under a medium or high vacuum condition; a branch passage that is branched from an gas-outlet of a lower stage number vacuum pump near to a gas-inlet of the vacuum pump unit, toward an air atmosphere; a low conductance line as a part of the branch passage; at least one check valve provided on the low conductance line so as to secure the low conductance property of the line; thereby, a part of a gas discharged from the gas-outlet of the lower number stage vacuum pump is branched and emitted toward an air atmosphere through the low conductance line. Therefore, the multistage vacuum pump unit can provide the same functions and effects as described in the above explanation as to the operational method.

BRIEF DESCRIPTION OF THE DRAWINGS

The present invention will now be described in greater detail with reference to the preferred embodiments of the invention and the accompanying drawings, wherein.

DESCRIPTION OF THE PREFERRED EMBODIMENTS

Hereafter, the present invention will be described in detail with reference to the embodiments shown in the figures. However, the dimensions, materials, shape, the relative placement and so on of a component described in these embodiments shall not be construed as limiting the scope of the invention thereto, unless especially specific mention is made.

(First Embodiment)

Figure 1:
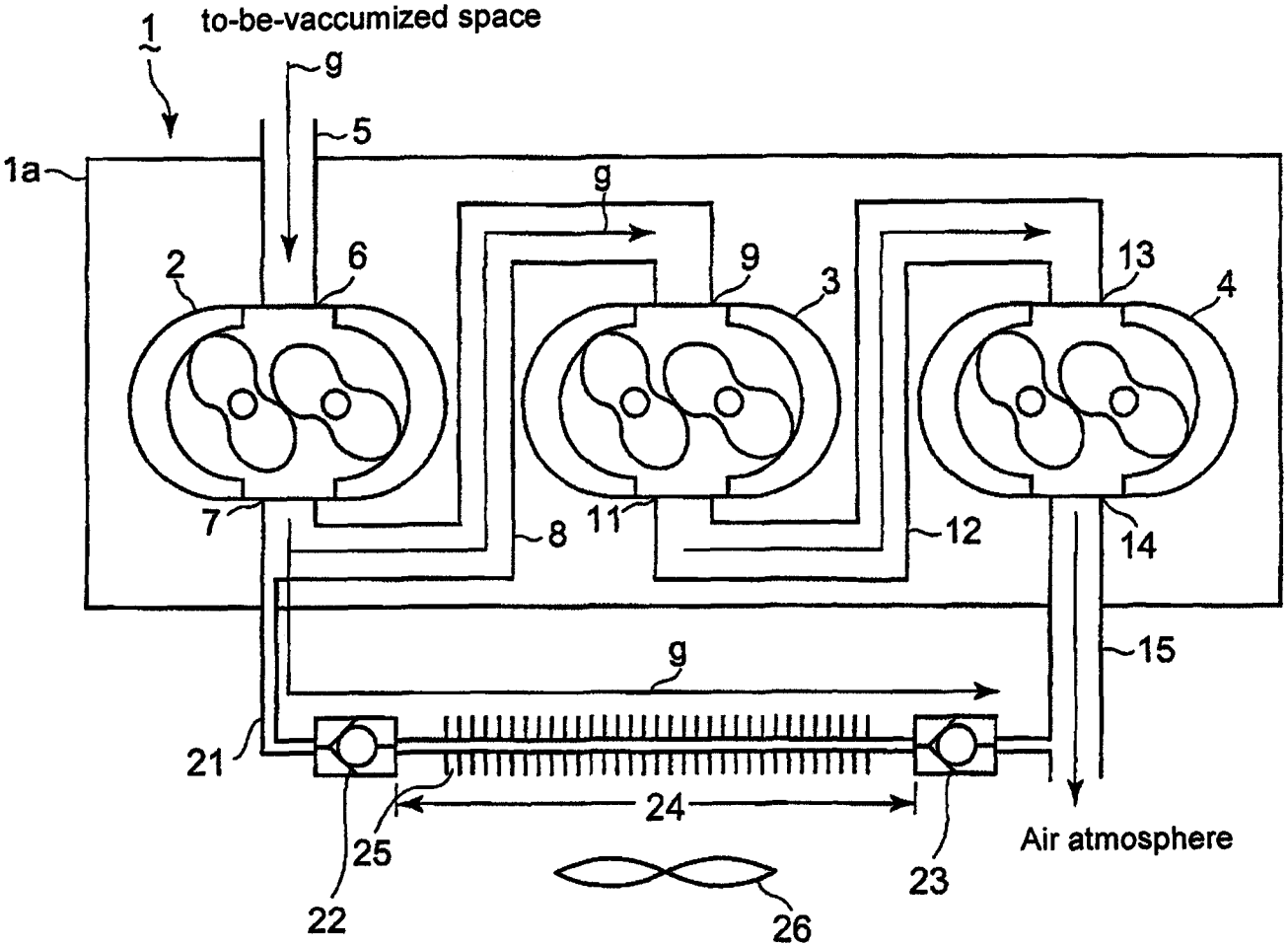
FIG. 1 depicts a cross section of a multistage vacuum pump unit as to the configuration according to a first embodiment of the present invention.

A first embodiment of the present invention here will be explained based on FIG. 1 which depicts a cross section of a multistage vacuum pump unit according to the first embodiment. In FIG. 1, the multistage vacuum pump unit 1 has a pump casing 1*a* in which three vacuum pumps 2, 3 and 4 are provided in series, forming a three stage pump unit; and gas passages communicating a gas-inlet of one pump with a gas-outlet of another pump. A suction passage 5 communicates the gas-inlet of the first stage vacuum pump 2 with a to-be-vacuumized container (not shown), namely, a closed container as a load-absorbing element.

A gas g inside the to-be-vacuumized container is inhaled into a first gas-inlet 6 of the first stage vacuum pump 2, through the suction passage 5; the gas g is compressed by the first stage vacuum pump 2, and the compressed gas g is discharged from a first gas-outlet 7 of the first stage vacuum pump 2, toward a first intermediate passage 8. The first intermediate passage 8 is connected to a second gas-inlet 9 of a second stage vacuum pump 3; the compressed gas g discharged into the first intermediate passage 8 is inhaled into the second stage vacuum pump 3; the compressed gas g inhaled into the second stage vacuum pump 3 is discharged from a second gas-outlet 11 of the second stage vacuum pump 3, toward a second intermediate passage 12.

The compressed gas g discharged into the second intermediate passage 12 is inhaled into a third stage vacuum pump 4, through a third gas-inlet 13 of the third stage vacuum pump 4; the compressed gas g inhaled into the third stage vacuum pump 4 is discharged from a third gas-outlet 14 of the third stage vacuum pump 4, through a discharge passage 15, toward an air atmosphere. In this way, the vacuum pumps 2, 3 and 4 are connected in a series through the first intermediate passage 8 and the second intermediate passage 12.

The first stage vacuum pump 2, the second stage vacuum pump 3 and the third stage vacuum pump 4 are driven by a common driving-shaft (not shown). The compression-ratio of each vacuum pump is designed so that the compression-ratio becomes larger as the stage number of each vacuum pump becomes bigger; namely, the bigger the stage-number of the vacuum pump is, the shorter the depth of the pump, because a smaller depth brings a smaller displacement (dead) volume.

A branch passage 21 diverges from the first intermediate passage 8; the branch passage 21 is led to the outside of the pump unit casing 1*a*. On a part way of the branch passage 21, a first check valve 22 and a second check valve 23 are installed, in order, from the upstream side. The branch passage 21 is connected to the discharge passage 15, at a downstream end of the branch passage 21. A part of the branch passage 21 from the first check valve 22 and the second check valve 23 is configured as a viscous flow line 24 of a low conductance.

The viscous flow line 24 is of long length and small bore so that the line has a low conductance property. In a typical multistage vacuum pump unit of a 1000 litter/sec capacity class, a bore for the first intermediate passage 8 and the second intermediate passage 12 is in a 20 to 30 mm level. In marked contrast with this level, according to the present invention, for example, a 4 mm length is adopted for the bore of the viscous flow line 24. Thus, the viscous flow line 24 is imparted a low conductance property, whereby the viscous flow line 24 becomes less capable of passing a gas-flow through the line 24. Accordingly, in a case when a relatively high-pressure gas is delivered through the viscous flow line 24, the gas can flow through the line 24 with a moderate pressure loss. On the other hand, a molecular gas flow or a transition gas flow under a relatively low pressure has a difficulty in passing through such a viscous flow line.

The opening pressure of the first check valve 22 is set so that the check valve 22 allows a gas branched from the first intermediate passage 8 to pass through the branch passage 21, in a case when the pressure of the gas branched from the first intermediate passage 8 is lower than a pressure of a gas discharged at the first gas-outlet of the first stage vacuum pump 2 under a low vacuum operation zone, as well as higher than the pressure of the air atmosphere. The first check valve 22 is set so as to open, for instance, when the pressure of the gas branched is between 0.12 to 0.15 MPa. On the other hand, the opening pressure of the second check valve 23 is set with a pressure higher than that of the first check valve by a certain pressure-increment.

In the way as described, in a case when the pressure of the gas branched from the first intermediate passage 8 is between an opening pressure of the first check valve 22 and an opening pressure of the second check valve 23, the first check valve 22 is opened and the second check valve 23 is closed; thus, in the described case, the branched gas is under a condition that the gas is provisionally accumulated in the viscous flow line 24.

Further, in the outer periphery surface of the viscous flow line 24, a lot of cooling fins 25 are implanted; and, in the neighborhood of the viscous flow line 24, a cooling fan 26 is provided so as to deliver cool air toward the cooling fins. In addition, a downstream side end of the branch passage 21 is connected to the discharge passage 15.

In the above-described configuration of the embodiment based upon the present invention, the gas g within the to-be-vacuumized container (not shown) is inhaled by each vacuum pump of the first stage, the second stage, or the third stage in the multistage pump unit 1; then, the gas g is discharged toward an air atmosphere through the discharge passage 15. In an early stage after the multistage vacuum pump unit is started whereby the pressure inside of the to-be-vacuumized container is close to the pressure of an air atmosphere or in a low vacuum operation zone, a part of a gas discharged from the first vacuum pump 2 flows into the branch passage 21 under a condition that the pressure of the gas discharged from the first vacuum pump 2 exceeds the set-pressure (a predetermined pressure) as an opening pressure of the first check valve 22 which is opened in response to the condition.

Thus, the pressure of a gas inhaled by the second vacuum pump 3 can be prevented from increasing into an excessive level; as a result, the power required in driving the vacuum pumps after they are started or while they are in a low operation zone can be reduced. Further, on the part way of the branch passage 21, are provided the first check valve 22 and the second check valve 23 which prevent the branched gas from flowing-back; in addition, between the first and second check valves, is provided the viscous flow line 24 of a low conductance property; so can be prevented even infinitesimal flow-back of the gas g inside the line 24.

Moreover, a plurality of cooling fins 25 are implanted in the outer periphery surface of the viscous flow line 24; and, a cooling fan 26 is provided in the neighborhood of the viscous flow line 24, so as to deliver cool air toward the cooling fins; therefore, the thermal load over the whole vacuum pump unit 1 can be lightened, and each pump 2, 3 or 4 can be free from a potential seizure risk.

Still moreover, the condition is set that the opening pressure of the second check valve 23 is set with a pressure higher than that of the first check valve by a certain pressure-increment; therefore, a gas pressure range can be set so that the first check valve 22 is opened and the second check valve 23 is closed. Thus, in the gas pressure range, the viscous flow line 24 can form a buffer-space that provisionally accumulates the gas g inside the line 24, the buffer-space can prevent a flow-back of the branched gas with an enhanced efficiency and promote a cooling effect of the branched gas. What is more, in a case when the second check valve 23 is of a low leakage specification, namely, of a reduced flow-back property, then, the opening and closing frequency of use as to the second check valve 23 can be reduced, and the life time as well as the reliability as to the second check valve 23 can be improved.

In the above-described explanation of the first embodiment, the downstream end of the branch passage 21 joins into the discharge passage 15. Yet, the downstream end of the branch passage 21 may be a direct opening toward an air atmosphere, without joining into the discharge passage 15.

(Second Embodiment)

Figure 2:
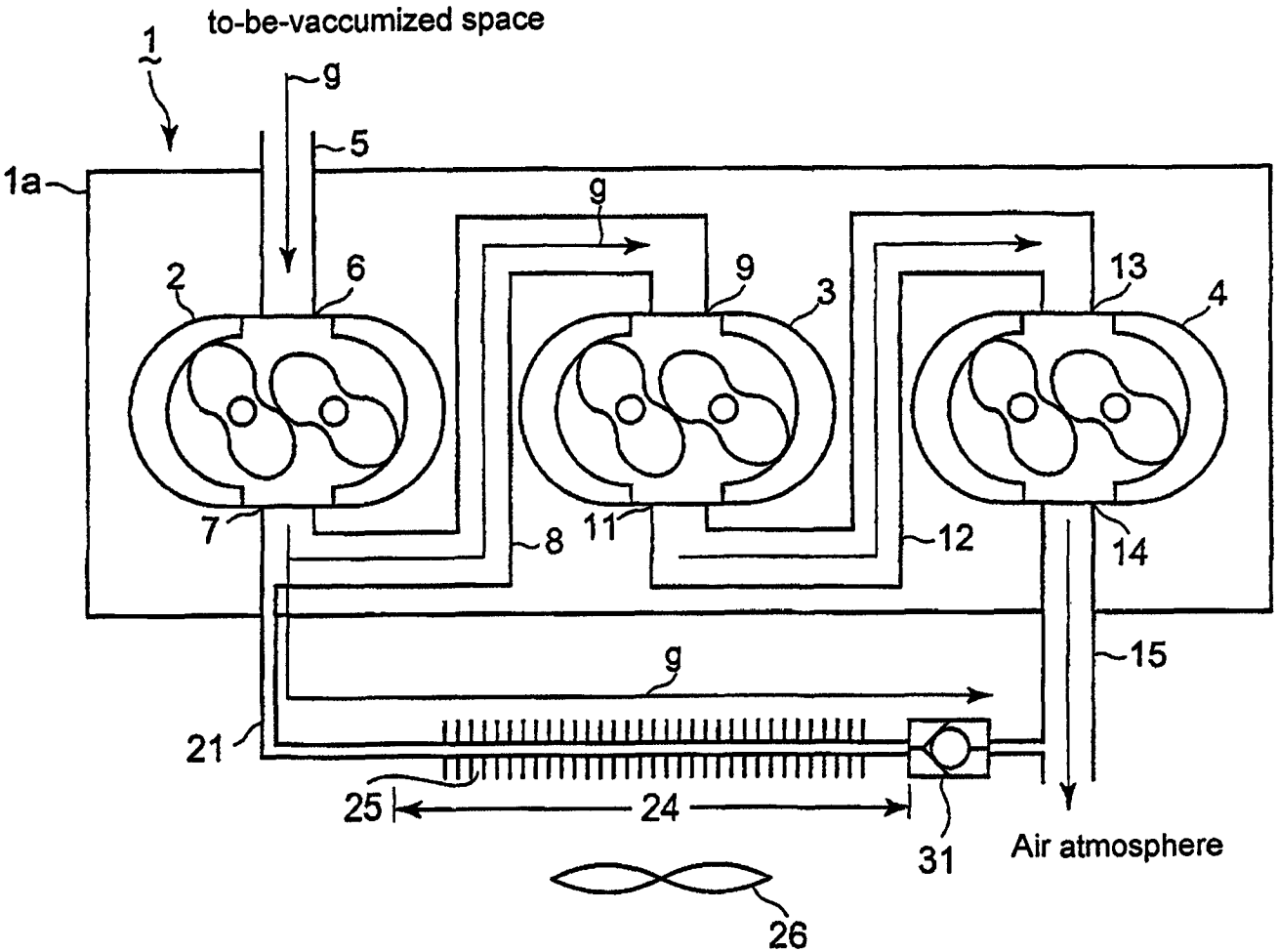
FIG. 2 shows a cross section of a multistage vacuum pump unit as to the configuration according to a second embodiment of the present invention.

Next, a second embodiment of the present invention here will be explained based on FIG. 2 which depicts a cross section of a multistage vacuum pump unit according to the second embodiment. In the embodiment, only a check valve 31 is provided on a downstream side of the viscous flow line 24 that forms a part of the branch passage 21. In other words, the configuration of the second embodiment is the same as that of the first embodiment, except that the first check valve 22 in the first embodiment is deleted.

Also, by means of the configuration of the second embodiment, a gas flow-back from the discharge passage 15 toward the branch passage 21 can be well prevented; in addition, since only one check valve is provided on a part way of the branch passage 21, the cost of facilities can be reduced.

Industrial Applicability

The present invention enables a multistage vacuum pump unit to save a power requirement; at the same time, a gas discharged outside of the multistage vacuum pump unit can be accurately prevented from flowing-back into a gas passage in the pumps or in the pump unit.

This application is based on, and claims priority to, Japanese Patent Application No: 2008-076234, filed on Mar. 24, 2008. The disclosure of the priority application, in its entirety, including the drawings, claims, and the specification thereof, is incorporated herein by reference.

What is claimed is:

1. A method of operating a multistage vacuum pump unit comprising a plurality of vacuum pumps connected in series and in a multistage arrangement, so that the space inside of a to-be-vacuumized container connected to a gas inlet of a first stage vacuum pump becomes under a high vacuum condition, the multistage vacuum pump unit having a low vacuum operation zone and a high vacuum operation zone, the method comprising the steps of:

branching part of the gas discharged from a gas-outlet of a lower number stage vacuum pump while the pump unit is operating under a low vacuum condition; and discharging the branched gas, toward an air atmosphere, through a branch passage including a low conductance line on which at least one check valve is provided for preventing the branched gas from flowing back;

wherein a bore and a length of the low conductance line are configured to enable a gas flow that is branched from a vacuum pump of a lower number stage, in the low vacuum operation zone, to pass through the low conductance line, and to enable a gas flow in the high vacuum operation zone, to be prevented from flowing back from the outlet side of the low conductance line.

2. The method according to claim 1, wherein:

the branched gas flows into a discharge passage from a final stage vacuum pump in the vacuum pump unit, after passing through the low conductance line; and the branched gas is discharged toward an air atmosphere, together with the discharge gas from the final stage vacuum pump, through the discharge passage from the final stage vacuum pump in the vacuum pump unit.

3. The method according to claim 2, wherein the at least one check valve on the low conductance line is controlled to open only when the pressure of the branched gas is higher than the pressure of an air atmosphere and lower than the pressure of the gas at the gas-outlet of the lower number stage vacuum-pump near to the gas-inlet side of the vacuum-pump unit while the pump unit is operating under a low vacuum condition.

4. The method according to claim 1, wherein the at least one check valve on the low conductance line is controlled to open only when the pressure of the branched gas is higher than the pressure of an air atmosphere and lower than the pressure of the gas at the gas-outlet of the lower number stage vacuum-pump near to the gas-inlet side of the vacuum-pump unit while the pump unit is operating under a low vacuum condition.

5. A multistage vacuum pump unit having a low vacuum operation zone and a high vacuum operation zone, comprising:

a plurality of vacuum pumps connected in series and in a multistage arrangement, so that the space inside of a to-be-vacuumized container becomes under a high vacuum condition;

a branch passage that is branched from a gas-outlet of a lower number stage vacuum pump near to a gas-inlet of the vacuum pump unit, toward an air atmosphere;

a low conductance line as part of the branch passage; and at least one check valve that is provided on the low conductance line, wherein part of the gas discharged from the gas-outlet of the lower number stage vacuum pump is branched and emitted toward an air atmosphere through the low conductance line;

wherein a bore and a length of the low conductance line are configured to enable a gas flow that is branched from a vacuum pump of a lower number stage, in the low vacuum operation zone, to pass through the low conductance line, and to enable a gas flow in the high vacuum operation zone, to be prevented from flowing back from the outlet side of the low conductance line.

6. The multistage vacuum pump unit according to claim 5, wherein:

the branch passage is led outside of a pump unit casing of the multistage vacuum pump unit; and the outer periphery of the branch passage or the low conductance line as part of the branch passage is cooled by a cooling device outside the pump unit casing.

7. The multistage vacuum pump unit according to claim 6, wherein:

the at least one check valve includes a first check valve and a second check valve installed on a part way of the branch passage so that the low conductance line is placed between the two check valves, and the opening pressure of the second check valve is set with a pressure higher than that of the first check valve; and the low conductance line forms a buffer-space that provisionally accumulates the gas branched into the low conductance line.

8. The multistage vacuum pump unit according to claim 6, wherein the cooling device is made from a plurality of fins are implanted in the outer periphery of the branch passage.

9. The multistage vacuum pump unit according to claim 6, wherein the cooling device is made from a water tank in which the branch passage is laid down, or a water jacket through which the branch passage is passed through.

10. The multistage vacuum pump unit according to claim 5, wherein:

the at least one check valve includes a first check valve and a second check valve installed on a part way of the branch passage so that the low conductance line is placed between the two check valves, and the opening pressure of the second check valve is set with a pressure higher than that of the first check valve; and the low conductance line forms a buffer-space that provisionally accumulates the gas branched into the low conductance line.

* * * * *